United States Patent [19]

Geil et al.

[11] Patent Number: 4,933,919

[45] Date of Patent: Jun. 12, 1990

[54] HYDROPHONE

[75] Inventors: Frederick G. Geil, Annapolis, Md.; William A. Bunker, Goleta, Calif.

[73] Assignee: Westinghouse Electric Corp., Pittsburgh, Pa.

[21] Appl. No.: 353,562

[22] Filed: May 18, 1989

[51] Int. Cl.[5] ..... H04R 17/00

[52] U.S. Cl. ..... 367/159; 367/164; 310/337; 310/369

[58] Field of Search ..... 367/159, 157, 155, 164; 310/337, 340, 369, 334; 381/189, 173, 190

[56] References Cited

U.S. PATENT DOCUMENTS

| | | | |
|---|---|---|---|
| 3,950,660 | 4/1976 | McElroy | 310/336 |
| 4,525,645 | 6/1985 | Shirley et al. | 367/159 |
| 4,636,998 | 1/1987 | Greene et al. | 367/154 |
| 4,821,244 | 4/1989 | Wood | 367/159 |
| 4,833,659 | 5/1989 | Geil et al. | 367/155 |
| 4,841,494 | 6/1989 | Banno | 367/157 |

*Primary Examiner*—Charles T. Jordan
*Assistant Examiner*—J. Woodrow Eldred

[57] ABSTRACT

A hydrophone having a hollow interior with signal electrodes on the interior surface and an electrically conducting coating over the entire outside surface. Signal leads are connected to the inside electrodes and the outside electrically conducting surface is connected to a point of ground potential to form an effective electromagnetic interference shield.

7 Claims, 5 Drawing Sheets

HYDROPHONE

BACKGROUND OF THE INVENTION

1. Field of the Invention:

The invention in general relates to electro-acoustic transducers, and in particular to an underwater hydrophone.

2. Description of the Prior Art:

Hydrophones, particularly those used in an anti-submarine warfare (ASW) application must be designed to exhibit a high sensitivity so that relatively low amplitude target signals will not be hidden by the electrical noise normally generated by the signal processing circuitry provided. For a typical ASW application, thousands of hydrophones may be utilized in a particular array and the hydrophones are connected to the signal processing circuitry via respective cables. Each of the hydrophones of the array must exhibit a relatively high capacitance to overcome the connecting cable capacitance without signal loss and present a low impedance source to the preamplifier utilized in the signal processing circuitry.

Of particular concern is electromagnetic interference (EMI) which can actually generate a signal on the output leads of the hydrophone and which signal may be displayed as a target, when in fact no target exists.

The hydrophone of the present invention is of a construction which exhibits high sensitivity and high capacitance in an arrangement which virtually eliminates the effects of EMI. This is accomplished in a hydrophone which is of relatively low cost and rugged so as to withstand the effects of possible nearby explosive shocks in an ASW environment.

SUMMARY OF THE INVENTION

In accordance with the present invention, a transducer is provided with has inner and outer surfaces and wherein the inner surface includes a plurality of signal electrodes. The entire outer surface of the structure includes an electrically conducting coating forming an electromagnetic interference shield which is connected to ground potential.

In its use as a hydrophone, a radially polarized hollow cylindrical body of transducer active material is provided which has first and second end caps respectively closing off the ends of the cylindrical body. The inside and outside surfaces of the cylindrical body are electroded to define a plurality of serially connected active transducer sections. The outside surface of each each cap also includes an electrically conducting coating with said electroded outside surface of the cylindrical body being electrically connected with the conducting coating on the end cap to form a unitary electrically conducting shield over the entire outside surface of the hydrophone. The inside surface includes at least first and second electrodes which are connected to the input of a balanced preamplifier while the electrically conducting shield on the outside surface is connected to electrical ground potential.

DESCRIPTION OF THE PREFERRED EMBODIMENT

Figure 1A:
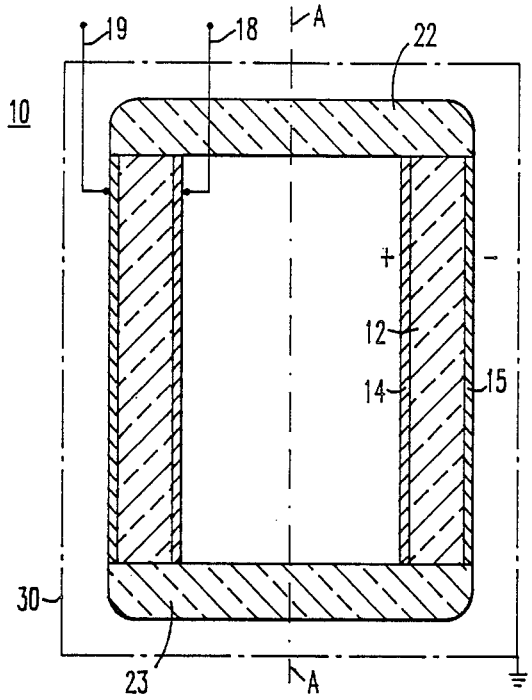
FIG. 1A PRIOR ART
FIGS. 1A and 1B are cross sectional views of typical prior art hydrophones used for ASW applications.

Referring now to FIG. 1A, there is illustrated, in cross sectional view, a prior art transducer which includes a thin walled cylindrical body 12 of a transducer active material such as barium titanate or lead zirconate titanate. Cylinder 12 is symmetrically disposed about a central longitudinal axis AA and includes an electrode 14 on its inner surface and an electrode 15 on its outer surface to which electric leads 18 and 19 are respectively connected.

The cylindrical body 12 is polarized in a radial direction and includes rigid end caps 22 and 23. When operated as a hydrophone, transducer 10 is subjected to impingement of acoustic waves which, due to the presence of rigid end caps 22 and 23 stress the cylinder 12 in the longitudinal direction to provide a corresponding output signal on leads 18 and 19. The sensitivity of the hydrophone may be increased to provide a higher output signal in response to the same acoustic signal by the arrangement illustrated in FIG. 1B.

Figure 1B:
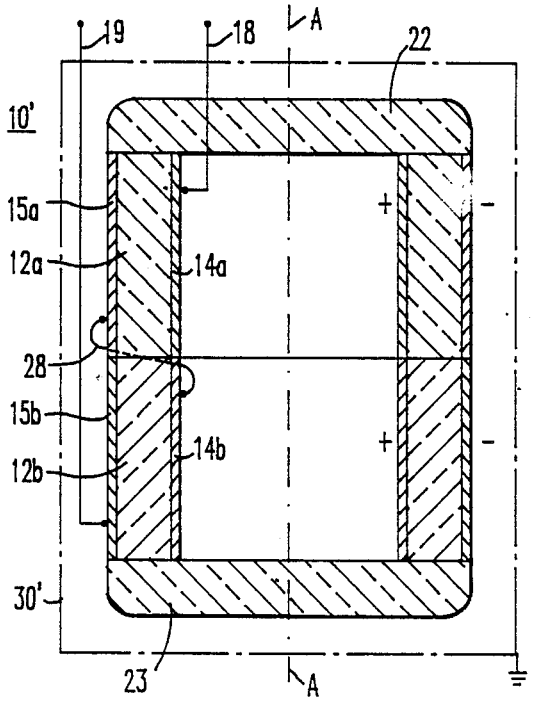
FIG. 1B PRIOR ART

In the transducer 10' of FIG. 1B, the cylindrical body of active transducer material is divided into two sections **12*a* and 12*b* each including respective inner and outer electrodes 14*a*, 15*a* and 14*b*, 15*b* with outer electrode 15*a* being connected to inner electrode 14*b* by means of lead 28. With this arrangement, the two halves 12*a* and 12*b* (which may be separate cylinders or a single cylinder) are in series, thereby giving rise to a higher voltage output at leads 18 and 19**.

Due to the operating environment of the hydrophone, electromagnetic signals present in the water (such as from electrical potentials provided by the carrier upon which the hydrophone is mounted) capacitively couple to whatever electrode is exposed, even though waterproofed, causing the generation of an output signal on leads 18 and 19. An output signal therefore is generated, representing a target, when in actuality no such target exists. Therefore, to eliminate the unwanted effects of electromagnetic interference (EMI) a grounded metallic shield in the form of a screen 30 (FIG. 1) surrounds the hydrophone. The shield must be accurately spaced from the hydrophone so that the capacitance contribution of the shield is insignificant compared to the capacitance of the hydrophone itself. In general, the greater the distance away from the hydrophone the less the capacitance contribution will be.

With the arrangement of FIG. 1B, wherein the hydrophone provides a higher output signal in response to the same acoustic pressure, the overall hydrophone capacitance is reduced to one quarter of that value of the FIG. 1A embodiment and accordingly the EMI shield 30' must be placed at a greater distance from the surface of the hydrophone. In a hydrophone array where thousands of hydrophones may be utilized, such required spacing becomes impractical.

Figure 2:
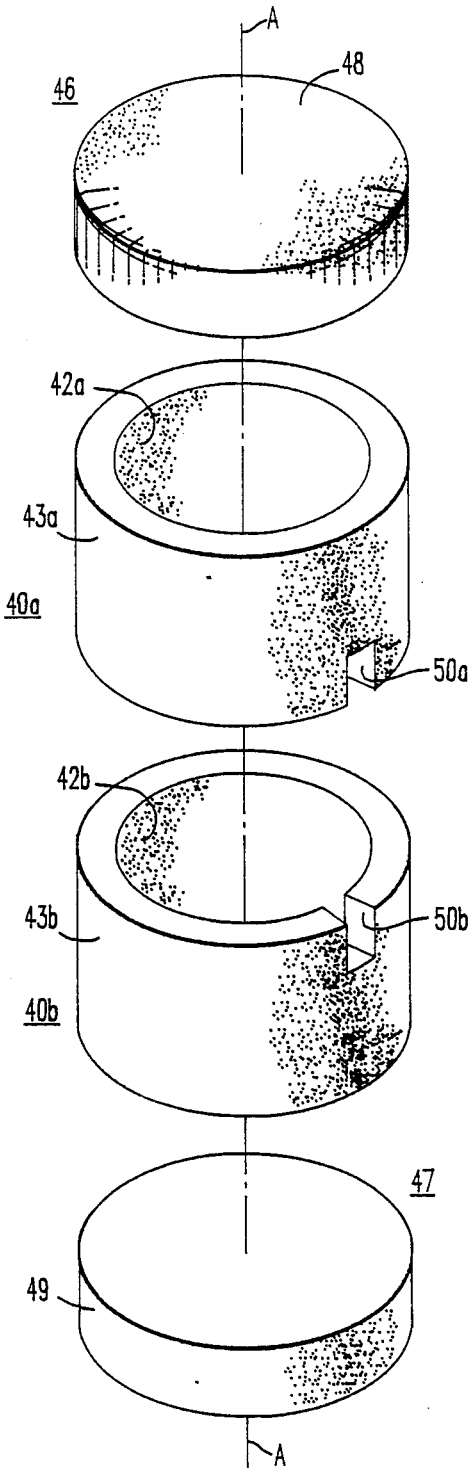
FIG. 2 is an exploded view of one embodiment of the present invention.
Figure 3:
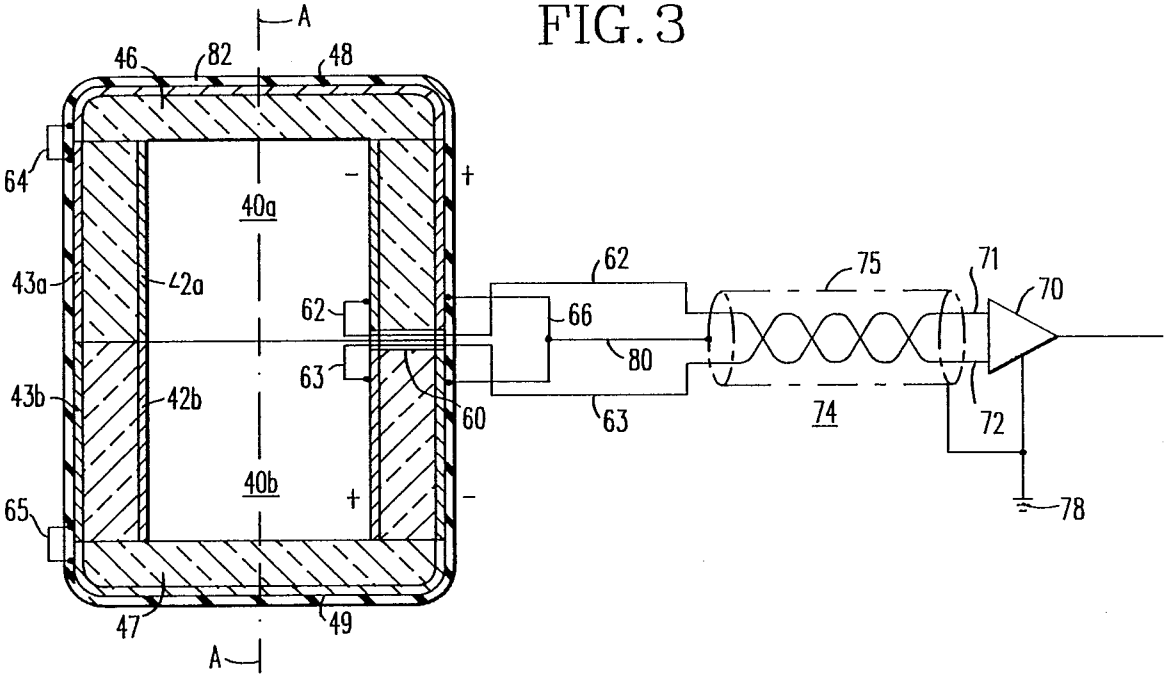
FIG. 3 is a cross-sectional view of the hydrophone of the present invention together with its electrical connection to a preamplifier.

An improved hydrophone in accordance with one embodiment of the present invention provides superior EMI shielding, is illustrated in the exploded view of FIG. 2 and the cross sectional view of FIG. 3. The hydrophone includes first and second cylindrical bodies 40a and 40b of transducer active material and having respective rigid end caps 46 and 47, all collectively extending along longitudinal axis AA. Cylinders 40*a* and 40*b*, which may be of barium titanate, include respective inner and outer electrodes 42*a*, 43*a* and 42*b*, 43*b*. End caps 46 and 47 which may be of a rigid ceramic material such as alumina, include on their outer surfaces respective electrically conducting coatings 48 and 49.

Cylinder 40*a* includes a notch 50*a* at the lower portion thereof and cylinder 40*b* includes a similar notch 50*b* at the upper portion thereof for a purpose to be described with respect to FIG. 3 to which reference is now made.

The notches in the cylinders 40*a* and 40*b* are aligned to accommodate an insert 60 for passages of leads 62 and 63 electrically connected to the internal electrodes 42*a* and 42*b*. Electrical connection 64 electrically connects the conducting coating 48 on end cap 46 to the outer electrode 43*a*, and connection 65 electrically connects the conducting coating 49 on end cap 47 to outside electrode 43*b*. Connection 66 electrically connects the outer electrodes 43*a* and 43*b*. All of the connections are such that the entire outer surface of the hydrophone has an electrically conducting coating which is connected to a ground potential to form an effective EMI shield.

The output signal provided by the hydrophone is derived from the inside electrodes 42*a* and 42*b* and the output electrical signal, corresponding to the impinging acoustic signal, is provided on output leads 62 and 63. The output signal is initially amplified by means of balanced preamplifier 70 having inputs 71 and 72 to which the output leads 62 and 63 are respectively connected by means of a shielded, twisted pair cable 74. The shield portion 75 of the cable is electrically connected to the preamplifier ground 78 and the outer electrically conducting coating over the entire surface of the hydrophone is effectively placed at ground potential by means of the connection 80 between shield portion 75 and connection 66.

In order to insulate the grounded shield system from sea water, there is provided a waterproof coating 82 over the entire surface of the hydrophone such that any EMI potential in the water surrounding the hydrophone has only capacitance coupling to the outer electrically conducting surface which itself is grounded thereby eliminating the deleterious effects of the EMI potential.

The embodiment of FIG. 3 includes two separate cylinders 40*a* and 40*b* radially polarized as illustrated by the positive and negative markings, and operated in a longitudinal mode. Although two separate cylinders are utilized, a single cylinder may be utilized, with suitable electrodes to define two serially arranged halves.

The hydrophone of FIG. 3 was constructed and tested and had the following specifications:

Transducer material—PZT Type I
Length of each cylinder—0.5"
Outside diameter of each cylinder—1.7"
Wall thickness of each cylinder—0.1"
End caps—Alumina
Waterproof coating—Polyethylene
Thickness of coating—0.125"
Length of cable—75'

Figure 4B:
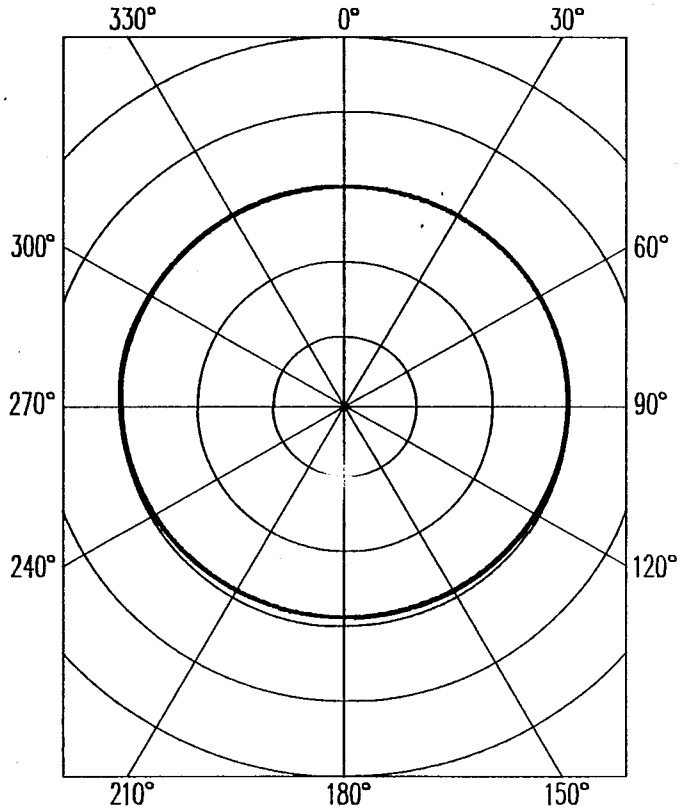
FIGS. 4A and 4B illustrate beam patterns and FIG. 5 illustrates sensitivity and frequency response of the hydrophone of the present invention.
Figure 4A:
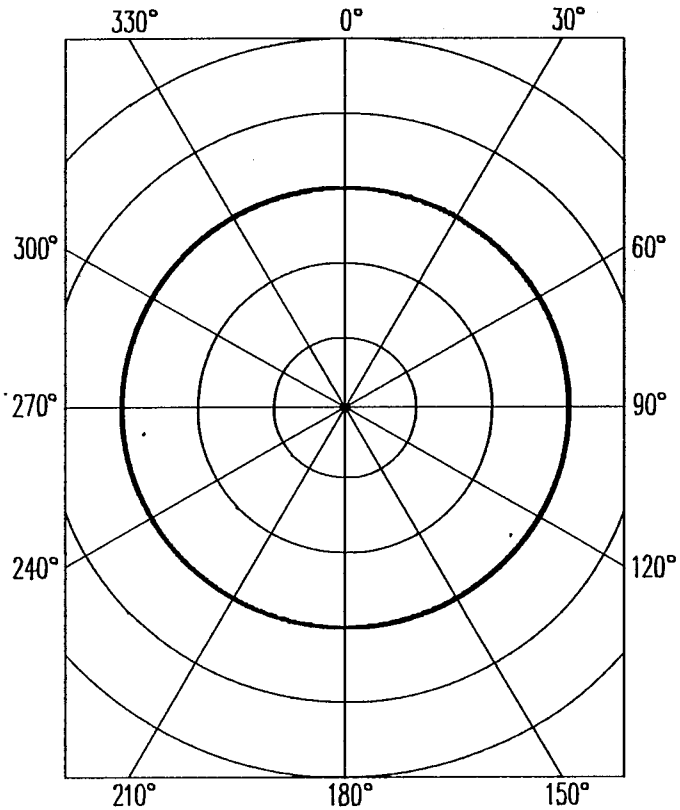
Figure 5:
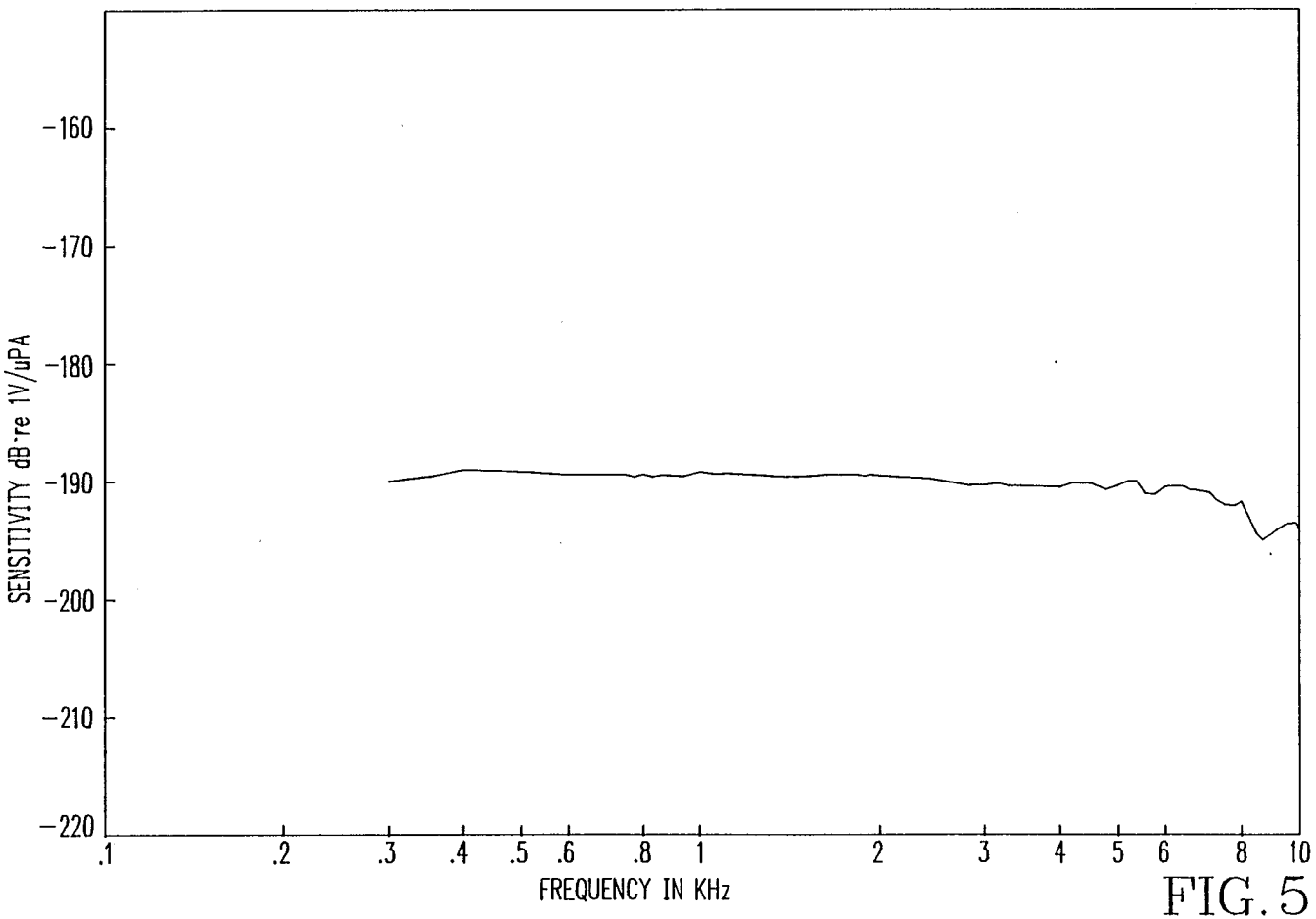

FIGS. 4A, 4B and 5 illustrate the results of such testing. FIG. 4A shows the beam pattern with the hydrophone rotated about its longitudinal axis and Figure 4B illustrates the beam pattern with the rotation perpendicular thereto. These beam patterns illustrate an exceptional omnidirectionality with the illustrated transducer construction. FIG. 5 shows the measured sensitivity and frequency response and illustrates a substantially flat response over the frequency range of interest.

A test for EMI susceptability improvement was performed as follows:

Two hydrophones as described in FIG. 3 were placed in air at a distance of 5" apart. One was driven while the other was used a receiver. The sound coupling, though inefficient because of the air medium, could be measured. The received level was −63 dBv at 10 KHz. Repeating the test using unshielded units (configuration as in FIG. 1A) was impossible because of electrical coupling between the hydrophones even though the outer electrodes of both hydrophones were maintained at ground potential. The electrical coupling, or cross talk, completely obscured the acoustic signal.

We claim:

1. A hydrophone comprising:
(a) a radially polarized, hollow cylindrical body of transducer active material extending along a longitudinal axis;
(b) first and second rigid end caps respectively closing off the ends of said cylindrical body, at least the outer portion of each said end cap being electrically conductive;
(c) said cylindrical body being operable in a longitudinal mode and having electroded inside and outside surfaces electrically connected to define a plurality of serially connected active transducer sections, each said section having a radial polarization opposite to that of an adjacent section;
(d) means electrically connecting said electroded outside surface of said cylindrical body with said electrically conductive portions of said end caps to form a unitary electrically conducting shield over the entire outside surface of said hydrophone;
(e) said electroded inside surface of said cylindrical body being divided into at least first and second electrodes;
(f) means for connecting said electrically conducting shield to an electrical ground potential.

2. Apparatus according to claim 1 which includes:
(a) a waterproof coating covering the entire surface of said electrically conducting shield.

3. Apparatus according to claim 1 wherein:
(a) said cylindrical body is comprised of two coaxial cylinders, arranged end to end.

4. Apparatus according to claim 3 wherein:
(a) each of said cylinders includes a notch at an end thereof, said end being the end which meets the end of the other cylinder;
(b) said notches of said cylinders facing one another to form an opening in said cylindrical body; and which includes,
(c) an electrical feedthrough disposed in said opening for making electrical connection with said first and second electrodes on the inside surface of said cylindrical body.

5. Apparatus according to claim 1 which includes:
(a) a cable for connection to said amplifier;
(b) said cable including first and second conductors;
(c) a cable shield surrounding said conductors;
(d) said first and second conductors being connected to said first and second electrodes;

(e) said cable shield being connected to said electrically conducting shield.

6. Apparatus according to claim 1 wherein:

(a) each said end cap is of a ceramic material having an electrically conductive coating on the outside surface thereof.

7. Apparatus according to claim 6 wherein:

(a) said end caps are of alumina.

* * * * *